United States Patent [19]

Brereton et al.

[11] Patent Number: 5,031,290

[45] Date of Patent: Jul. 16, 1991

[54] PRODUCTION OF METAL MESH

[75] Inventors: Colin Brereton, Middlewich; Michael J. Edwards, Dudley; Peter C. S. Hayfield, Bickenhill, all of Great Britain

[73] Assignee: Imperial Chemical Industries PLC, London, England

[21] Appl. No.: 479,687

[22] Filed: Feb. 14, 1990

[30] Foreign Application Priority Data

Feb. 14, 1989 [GB] United Kingdom ..... 8903321

[51] Int. Cl.[5] ..... C25B 11/10

[52] U.S. Cl. ..... 29/6.1; 29/527.2; 29/527.4; 204/147; 204/196; 204/290 F; 427/125; 427/126.3; 427/126.5; 427/171; 427/292; 427/383.7

[58] Field of Search ..... 204/147, 148, 196, 197, 204/290 F; 29/6.1, 527.2, 527.4; 427/125, 126.3, 126.5, 171, 290, 292, 383.7

[56] References Cited

U.S. PATENT DOCUMENTS

| | | | |
|---|---|---|---|
| 3,206,536 | 9/1965 | Goodloe | 29/6.1 |
| 3,228,786 | 1/1966 | Fitzgerald et al. | 427/290 |
| 3,297,461 | 1/1967 | Siddall | 427/290 |
| 3,671,415 | 6/1972 | King et al. | 204/290 F |
| 4,068,366 | 1/1978 | Hillesheim | 29/527.4 |
| 4,708,888 | 11/1987 | Mitchell et al. | 204/290 F |

*Primary Examiner*—T. Tung

*Attorney, Agent, or Firm*—Cushman, Darby & Cushman

[57] ABSTRACT

A process for the production of an open metal mesh the surfaces of which are coated with a coating of an electrocatalytically-active material, the process comprising forming a plurality of slits in a sheet of metal, applying a coating of an electrocatalytically-active material to the slit sheet, and stretching the coated sheet to expand the sheet and form the open mesh. The mesh is suitable for use as an anode in cathodic protection of steel-containing structures, for example, steel-reinforced concrete structures.

14 Claims, No Drawings

PRODUCTION OF METAL MESH

This invention relates to a metal mesh and to a process for producing the mesh. The mesh is particularly suitable for use as an electrode in electrochemical applications, especially as an anode in cathodic protection applications, e.g. in the cathodic protection of the steel reinforcement in a reinforced concrete structure, and the invention also relates to a cathodic protection system containing the mesh as an anode.

Cathodic protection of metal structures, or of metal-containing structures, in order to inhibit or prevent corrosion of the metal of the structure is well-known. In one system for the cathodic protection of such a structure an electrode is spaced from the metal of the structure with an electrolyte between the metal of the structure and the electrode. The electrode and the metal of the structure form a galvanic cell in which the electrode becomes anodically polarized and the metal of the structure becomes cathodically polarized thereby inhibiting or preventing corrosion of the metal of the structure. In an alternative system the electrode and the metal of the structure are connected to a source of D.C. electrical power and in operation the metal of the structure is cathodically polarized and the electrode spaced therefrom is anodically polarized in order that corrosion of the metal of the structure may be inhibited or prevented. Such cathodic protection of metal or of metal-containing structures, particularly of steel structures, is practised on a wide scale, particularly in marine environments, e.g. in the protection of offshore steel drilling platforms and oil wells and of steel pipes submerged beneath the sea, and in the protection of the hulls of ships. Cathodic protection is also used to inhibit or prevent corrosion of structures such as pipelines buried in the ground.

A particular problem is associated with the inhibition or prevention of corrosion of steel reinforcement bars, hereafter referred to as rebars, in steel-reinforced concrete structures. The corrosion of rebars in such concrete structures may be caused by the presence of water in the porous concrete of the structure, and/or by the presence of chloride ions in this water. Chloride ions may be present as a result of using chloride-contaminated aggregate and/or chloride-contaminated water in the production of the concrete, and/or of using chloride-containing de-icing salts on the structure which percolate into the porous concrete of the structure and come into contact with the rebars. The use of such chloride-containing de-icing salts in contact with reinforced concrete structures is a particularly severe problem with structures such as bridges, particularly bridge decks, and parking garages, and with the supports for such structures.

Corrosion of the rebars in such a structure may vary from a relatively minor problem of discolouration of the structure caused by rust streaks, through spalling and cracking of the concrete of the structure caused by the increase in volume of rust compared with that of the steel of the rebar, up to complete and possibly catastrophic failure of the structure caused by complete failure of the rebars.

Many different systems have been proposed for the cathodic protection of such rebars in all of which an electrode which in operation functions as an anode is in electrical contact with the structure, and the rebars are cathodically polarized. In most such systems the electrode which is anodically polarized is covered with a protective layer, e.g. a cementitious layer, which serves to protect the anode and to assist in providing electrical contact between the anode and the concrete of the structure.

In a first type of system which has been proposed the electrode which in operation functions as an anode may be a sacrificial anode and electric current is caused to flow as a result of galvanic action. In operation of such a system an external source of electrical power is not applied. An example of such a system is one in which the sacrificial anode is in the form of plurality strips of zinc, or a perforated zinc sheet, placed over the surface of the structure. Such a system suffers from the disadvantages that in operation the sacrifical anode is consumed and it must be renewed periodically and, more importantly, as the electrical resistance of the concrete is substantial there may be insufficient voltage to produce the necessary current to achieve cathodic protection.

In a second type of system, the so-called impressed current type, which is more widely used in practice, the electrode which in operation functions as an anode is generally regarded as "permanent" in the sense that it is not consumed at a significant rate in operation of the system, and operation of the system depends upon application of an external source of electrical D.C. power. Many systems of this second type have been proposed and some will be described merely by way of example.

In such a system the anode may be in the form of a flexible wire, e.g. a platinum wire, which is installed in slots in the concrete structure with the slots being covered by carbonaceous or other backfill. In published GB Patent application 2 140 456 there is described a system in which the anode is a film of electrically conductive material applied to an external surface of the concrete structure. The electrically conductive film may be an electrically conductive paint comprising a conductive pigment, e.g. graphite, carbon or coke breeze in an organic binder such as an epoxy resin. In published European Patent application 0 147 977 there is described a cathodic protection system in which the anode comprises a plurality of elongate strands which are joined together to form a flexible open mesh, at least some of the strands being electrically conductive and comprising carbonaceous material. The strands may be for example of carbon fibre, or they may comprise a metal core, e.g. of copper, and an electrically conductive coating on the core which comprises an organic polymer and a carbonaceous material dispersed in the polymer. In GB Patent 2 175 609 there is described a cathodic protection system in which the anode is an extended area anode comprising a plurality of wires of valve metal, e.g. of titanium, in the form of an open mesh and on the wires a coating of an electrocatalytically-active material which is substantially non-consumable in operation, e.g. a coating of a platinum group metal or of an oxide of a platinum group metal. The mesh structure may be formed by weaving or knitting or it may be in the form of a welded structure, that is in the form of a network of strands welded together where the strands cross. In U.S. Pat. No. 4,708,888 there is described a cathodically protected steel reinforced concrete structure comprising an impressed current anode which is a valve metal mesh having a pattern of voids defined by a network of valve metal strands. The mesh may be produced by expanding a sheet of valve metal by a factor of at least 10, and even by a factor of up to 30, and the mesh has a coating of an electrocatalytically-active material on the surface thereof.

Where the electrode which is anodically polarized is made of a valve metal it is necessary for the surface of the valve metal to have a coating of an electrocatalytically-active material. If the valve metal did not have such a coating it would rapidly become passivated when anodically polarized due to formation of a non-conducting oxide film on the surface of the electrode with the result that the electrode would soon cease to pass a current. In order to ensure that the electrode will continue to pass a current and continue to function as an anode when it is anodically polarized it is necessary to have a coating of an electrocatalytically-active material on the surface of the electrode, as described in the aforementioned GB Patent 2 175 609 and U.S. Pat. No. 4,708,888.

The present invention is concerned with electrodes comprising a metal mesh, e.g. a valve metal mesh, coated with an electrocatalytically-active material, and with the production of such a mesh coated with an electrocatalytically-active material.

Such a material may be applied to an open metal mesh in a number of different ways. For example, the material may be applied to the mesh by electrolytic deposition from a solution of a suitable precursor compound of the electrocatalytically-active material. Thus, the mesh may be immersed in such a solution and the mesh cathodically polarized. Alternatively, the material may be applied to the surface of the mesh by vacuum deposition or by sputtering. In a preferred method of applying such a coating to the surface of the mesh the mesh may be coated with a solution or a dispersion of a precursor compound of the electrocatalytically-active material and the thus coated mesh heated to dry the coating and to decompose the precursor compound and convert it to the desired electrocatalytically-active material. In this preferred method the coating may be applied by, for example, painting or spraying the solution or dispersion onto the mesh or by immersing the mesh in the solution or dispersion.

As the open metal mesh may be of considerable size, for example, as much as 50 meters or more in length and about 1 or 2 meters or more wide, coating of the mesh may present some problems, particularly handling problems, e.g. when the mesh is coated electrolytically or when the mesh is coated by immersing the mesh in a solution or dispersion of a precursor compound of the electrocatalytically-active material and the coated mesh then heated in an oven. It clearly would be inconvenient to immerse a mesh of such dimensions in a solution or dispersion and then heat the coated mesh in an oven. In particular large tanks to contain the solution or dispersion and large ovens would be required. An obvious way to overcome the problem of handling such a large size mesh and of avoiding the need to use large tanks and ovens, would be to coat the mesh, and to heat the mesh if necessary, when the mesh is in the form of a coil, particularly as a mesh which is produced by expansion of metal sheet is generally produced and stored in the form of a coil prior to use. A mesh in the form of a coil, although still somewhat bulky and not of a shape which can be handled very readily, would clearly be much easier to handle than would a mesh in an uncoiled form and would not require the provision of large size tanks and ovens. When ready for use the coated mesh could be uncoiled. The application of a coating of an electrocatalytically-active material to a mesh of a valve metal which is in the form of a coil is described in U.S. Pat. No. 4,708,888, the process involving the steps of applying a solution of a precursor compound of the material to the mesh when the mesh is in the form of a coil, e.g. by dipping the coil in a solution of the precursor compound, and subsequently drying the coated mesh and decomposing precursor compound in the dried coating to form the electrocatalytically-active material on the surface of the mesh. The steps of applying the solution to the coiled mesh, drying of the applied coating, and decomposition of the precursor compound to form the electrocatalytically-active material may need to be repeated several times in order to build up the required coating thickness on the surface of the mesh. Thus, repeated application of coating solution to the coiled mesh, and repeated heating of the coated mesh in an oven may be necesary.

The present invention relates to a process in which an open metal mesh coated with an electrocatalytically-active material is produced in which the aforementioned handling problems are overcome and the need to use large size equipment is eliminated. The process also does not involve repeated handling of a mesh in coiled form, e.g. repeated application of a coating solution to the coiled mesh and repeated heating of the coated coiled mesh in an oven.

According to the present invention there is provided a process for the production of an open metal mesh the surfaces of which are coated with a coating of an electrocatalytically-active material, the process comprising forming a plurality of slits in a sheet of metal, applying a coating of an electrocatalytically-active material to the slit sheet, and stretching the coated sheet to expand the sheet and form the open mesh.

As has been stated hereinbefore application of the coating to an already-formed mesh is attended by some difficulties, generally difficulties of handling the mesh associated with the large size of the mesh, even when the mesh is in the form of a coil. On the other hand, coating of a substrate such as a sheet before it is in mesh form will clearly not be associated with such handling difficulties as the sheet will generally have such dimensions that it can easily be handled, indeed the sheet may have dimensions substantially similar to those of electrodes, e.g. mesh electrodes, which are conventionally used in electrolytic cells, thus enabling conventional and available equipment, e.g. coating baths and ovens, to be used for coating the sheet from which the coated open metal mesh is produced by expansion of the coated slit sheet.

U.S. Pat. No. 4,708,888 has already been referred to. This U.S. patent was granted on U.S. patent application Ser. No. 855,551, which was itself a continuation-in-part of patent application Ser. No. 731,420. In this latter patent application it is stated that "the expanded metal mesh can be useful as a substrate for coating", that is with an electrocatalytically-active material, and it is also stated that "the substrate may also be coated before it is in mesh form". This latter patent application thus describes application of a coating of an electrocatalytically-active material to the mesh itself and also to the substrate from which the mesh is produced by expansion. However, where a substrate such as a sheet is coated with an electrocatalytically-active material and the sheet is subsequently converted to a mesh form by slitting and stretching the coated sheet the resultant mesh has a coating on a part only of the surfaces of the strands of the mesh, specifically the mesh has a coating only on those surfaces of the strands of the mesh which lie generally in the plane of the mesh whereas those surfaces of the strands of the mesh which are generally transverse to the plane of the mesh are uncoated.

We have found that the presence of these uncoated surfaces on the strands of the mesh may lead to problems when the mesh is used in a cathodic protection application, or even in other types of electrochemical application. Specifically, we have found that the useful lifetime of the coated mesh, that is the time for which the mesh is capable of passing the desired electrical current at an acceptable voltage, may not be as great as may be desired. We believe that this reduced lifetime may be associated with undermining of the coating by the electrolyte and/or by the products of electrolysis, e.g. by acid produced during electrolysis, as a result of some surfaces of the mesh being uncoated, possibly leading to loss of the coating from those surfaces of the strands of the mesh lying generally in the plane of the mesh. On the other hand in the process of the present invention the sheet of metal is first slit then coated, and those surfaces exposed in the slitting step are thus also coated with the result that when the slit and coated sheet is stretched to expand the sheet and form the open metal mesh a mesh is produced in which all surfaces of the strands of the mesh may be coated, thus overcoming the aforementioned problems.

In the process the sheet which is expanded is a metal sheet. In general it will be a valve metal sheet, e.g. a sheet of titanium, tantalum, niobium, hafnium, zirconium or tungsten, or of an alloy of one or more of the said metals and having similar properties. On economic grounds titanium and alloys thereof are preferred. The sheet may have dimensions which enable it to be handled easily. For example, the sheet may be rectangular in shape, as such a shape is conveniently used in the expansion step of the process, and the sheet may have a width in the range 0.02 meters to 5 meters and a length in the range 0.25 meters to 5 meters or substantially more, although the process may be effected with a sheet having dimensions outside these ranges and these dimensions are given merely by way of example. For example, where the sheet is narrow, e.g. of width of the order of 0.2 meters, the sheet may be in the form of a long strip, e.g. a strip of length 100 meters or more.

In a first step of the process of the invention a plurality of slits is formed in the metal sheet by methods which are known in the art of production of expanded metal mesh. The slits may be formed by use of appropriately positioned knives.

The sheet will generally be oblong in shape and will generally have a pair of relatively long sides and a pair of relatively short sides, and a series of parallel slits may be formed in the sheet. Slightly different methods of forming the slits may be used. In a first method slits may be formed across the width of the sheet between the relatively long sides and after coating, the thus slit and coated sheet may be expanded by stretching the sheet lengthwise. In a second method slits may be formed along the length of the sheet between the relatively short sides and, after coating, the thus slit sheet may be expanded by stretching the sheet widthwise.

The dimensions of the sheet from which the open metal mesh is formed in the process of the invention will be chosen bearing in mind the particular method by which the sheet is to be stretched and expanded after slitting and coating. In general the expansion is effected by uniaxial stretching of the sheet. Thus, where a sheet is expanded lengthwise in the first method as described the width of the sheet will be approximately the same as that desired in the open mesh whereas the length of the sheet will be much less than the required length of the open mesh. For example the sheet may have a width of approximately 1 meter, or 2 meters, or of whatever width is desired in the open metal mesh. The sheet may have any desired length and be expanded at least to the desired length of the open mesh. Where the sheet is expanded widthwise by the second method the sheet will be relatively long and have a length at least as great as that required in the open mesh whereas the width of the sheet will be much less than the required width of the open mesh. For example, the sheet may have a width of a few cm, e.g. a width of 2 cm where the sheet is to be expanded by a factor of 50 to produce an open mesh 1 meter wide. In operation of this second method of expansion the sheet which is to be expanded may be in the form of a narrow strip.

The lengths of the slits formed in the sheet, and their spacing one from another, and the extent to which the sheet is stretched and expanded in a later step of the process, determine the dimensions of the open mesh, the width of the metal strands from which the mesh is composed, and the dimensions of the individual meshes.

The spacing of the slits one from another may be as much as 10 mm in which case the strands of the mesh which is produced will also have a dimension of up to 10 mm. However, the spacing of the slits one from another will generally be no more than 5 mm. In order that the mesh which is produced shall have adequate strength the spacing of the slits one from another, and thus the dimension of the strands of the mesh which is produced, will generally be at least 0.2 mm, preferably at least 0.5 mm, although the aforementioned spacings are given for general guidance only and are not meant to be limiting.

The dimensions of the strands of the open metal mesh produced in the process of the invention are also determined in part by the thickness of the sheet which is used in the process. For reasons hereinbefore referred to the sheet will generally have a thickness of at least 0.2 mm, preferably at least 0.5 mm. In general the sheet will have a thickness of not greater than 5 mm, preferably not greater than 2 mm.

In a further step of the process a coating of an electrocatalytically-active material is applied to the slit sheet. As it will generally be desirable for substantially the whole of the surfaces of the open metal mesh to be so coated it is preferred that substantially the whole of the surfaces of the slit sheet are so coated, that is both faces of the sheet and the surfaces exposed by the slitting step. The function of the electrolytically-active material is to enable the metal mesh which is produced in the process to function as an anode and to continue to pass an electrical current when it is anodically polarized. Many metals, and particularly valve metals, passivate due to the formation of an oxide layer on the surface of the metal when the metal is anodically polarized and the presence of a coating of an electrocatalytically-active material on the surface of the metal is essential if the metal is to continue to function as an anode.

Electrocatalytically-active materials are well-known in the electrode art and suitable materials will now be described merely by way of example. Materials other than those specifically described may be used as a coating on a face of the metal sheet.

The electrocatalytically-active material may be a metal selected from the platinum group, or it may be an alloy of two or more metals selected from the platinum group, or it may be an oxide of a metal selected from the platinum group, or a mixture of two or more such oxides, or a mixture of one or more metals selected from the platinum group with one or more oxides thereof. Other electrocatalytically-active materials which may be used include a mixture of, or a solid solution of, one or more oxides of metals selected from the platinum group and one of more oxides of valve metals. Specific electrocatalytically-active materials which may be mentioned include platinum metal itself, a solid solution of ruthenium oxide and titanium oxide, a mixture of platinum metal and iridium oxide, and iridium oxide, the latter two coatings being particularly suitable where oxygen is to be evolved during use of the mesh as an anode.

Other electrocatalytically-active materials may be used.

Methods of application of such electrocatalytically-active coatings are also well-known in the electrode art and it is not necessary to describe such methods in detail. In general the coatings are deposited on the surfaces the slit sheet from a solution or dispersion of a decomposable precursor compound or compounds of the material, e.g. of the platinum group metal or metals, the solution or dispersion optionally containing a decomposable compound of a valve metal. The solution or dispersion may be deposited on the surface of the sheet by painting or by spraying, or by immersing the sheet in the solution or dispersion. The compound or compounds may be converted to the electrocatalytically-active material, e.g. to a platinum group metal or oxide thereof, by firing of the coating on the surface of the sheet at elevated temperature, e.g. in an oxygen-containing atmosphere, or by depositing the metal or oxide from the solution electrolytically. A suitable temperature is in the range 400° C. to 900° C., depending on the nature of the precursor.

Repetition of the steps of deposition of a coating of the solution or dispersion and conversion of the decomposable compound to a metal or oxide may be required in order that the metal sheet shall have a desired loading of electrocatalytically-active material on the surfaces thereof. A preferred loading is at least 1 $g/m^2$ of electrocatalytically-active material on the surfaces of the sheet prior to stretching in order that the loading of the material on the open metal mesh which is produced in the process should be sufficient to ensure that the metal mesh will function as an anode for an acceptable length of time. In general the greater is the loading of electrocatalytically-active material on the surfaces of the sheet the longer will be the operational lifetime of the metal mesh as an anode, and for this reason a loading of electrocatalytically-active material on the surface of the sheet of at least $2\frac{1}{2}$ $g/m^2$ is preferred. In general it will not be necessary to have a loading in excess of 50 $g/m^2$.

Prior to application of the coating of electrocatalytically-active material the metal sheet may be cleaned, e.g. by sand-blasting and/or by immersion in a dilute aqueous solution of an acid. This cleaning may be effected before or after slitting of the sheet, but preferably after the slitting step. Furthermore, prior to application of the coating of electrocatalytically-active material to the sheet a pre-coat may be applied to the sheet, e.g. a coating of valve metal oxide, e.g. tantalum or titanium oxide. Such a pre-coat may be applied by techniques lnown in the art.

In a further step of the process the coated slit sheet is stretched to expand the sheet and form the open mesh. Methods of stretching are known in the art, and the extent of the stretching will be chosen to yield an open mesh having the desired voidage.

Although the characteristics of the open metal mesh which are required will be determined at least to some extent by the particular electrode use to which the mesh is to be put the mesh will generally have a voidage of at least 80%, and where the mesh is to be used as an anode in a cathodic protection system, the voidage will generally be at least 90%. The voidage may be as much as 98%. However, the mesh may have a voidage of less than, and even substantially less than, 80%. The extent of the stretching which is effected in the process will be chosen to produce an open metal mesh having the desired voidage.

The open metal mesh will generally have a diamond-shaped pattern. The dimensions of the individual meshes will also depend on the particular electrode use to which the mesh is to be put, but where the mesh is to be used as an anode in a cathodic protection system, especially in a system for the cathodic protection of the reinforcement bars in a steel-reinforced concrete structure the meshes suitably have an LWD in the range 5 to 250 mm and an SWD in the range 3 to 100 mm.

The extent to which the metal sheet is stretched in the process of the invention will generally be at least 10:1, preferably at least 20:1, and it may be as much as 30:1 or greater.

The mesh which is produced by stretching of the slit sheet comprises strands which have faces which lie in the general plane of the mesh and faces which lie in a direction transverse to the general plane of the mesh. If desired the mesh may be flattened, e.g. by rolling.

After expansion of the metal sheet the mesh may suitably be rolled up for storage prior to use.

The present invention also provides an open metal mesh, the surfaces of which are coated with a coating of an electrocatalytically-active material and produced by a process as herein described.

The coated open metal mesh of the invention may be used as an electrode in many different applications, but it is particularly suitable for use as an anode in different types of cathodic protection systems, for example, in systems for the cathodic protection of steel-containing structures which are buried in the ground where they come into contact with water which may be brackish and as a result of which the steel containing structures corrode. Examples of such steel-containing structures include pipelines, steel-containing support structures, and storage tanks which are partly or even completely buried below ground. Other structures which may be cathodically protected against corrosion include such steel-containing structures which are immersed in water, particularly in salt-water, e.g. sea-water. Structures of this type include steel pipelines, particularly off-shore pipelines for carrying gas and oil, and the steel-containing support legs of oil and gas drilling and production platforms, particularly such platforms which are used off-shore.

However, the coated open metal mesh of the invention is particularly adapted for use as an anode in a system for the cathodic protection of the steel reinforcement in a reinforced concrete structure where corrosion of the reinforcement bars is caused by water present in the concrete, and by salts in the concrete present as a result of the use of contaminated aggregate and/or water and/or as a result of the use of de-icing salts on the structure.

In a further embodiment of the invention there is provided a system for the cathodic protection of a steel-containing structure which system comprises a structure having steel therein and one or more electrodes spaced from the steel of the structure, in which the electrodes are provided by a coated open metal mesh as hereinbefore described. In operation the system is provided with a source of D.C. electrical power and the steel of the structure is cathodically polarized and the electrodes are anodically polarized. The system will usually be for the cathodic protection of steel reinforcement bars in a reinforced concrete structure and it will comprise a concrete structure having steel reinforcement bars therein and one or more electrodes in electrical contact with the structure and spaced from the reinforcement bars in the structure, in which the electrodes are provided by one or more coated open metal meshes as hereinbefore described.

The reinforced concrete structure may take any convenient form. For example, the structure may be a bridge deck or other roadway, as in a parking garage, or it may be a pillar, e.g. a supporting pillar for an elevated roadway or a supporting pillar in a building, or a beam in a building. The concrete structure contains rebars, and generally a plurality of such rebars spaced apart from each other and distributed throughout the structure. The rebars may take any convenient form. For example, in a pillar or in a beam in a building the rebars may be in the form of separate spaced apart steel bars, whereas in a bridge-deck or roadway the rebars may be in the form of a mesh, e.g. a mesh formed of separate steel bars which are welded together at the points at which the bars cross.

The coated open metal mesh produced in the process of the invention is found to operate satisfactorily as an anode in cathodic protection systems. Such systems are generally operated at relatively low anode current densities, e.g. at anode current densities in the range 20 $mA/m^2$ to 1000 $mA/m^2$, based on the real surface area of the anode.

We claim:

1. A process for the production of an open metal mesh the surfaces of which are coated with a coating of an electrocatalytically-active material, the process comprising forming a plurality of slits in a sheet of metal, applying a coating of an electrocatalytically-active material to the slit sheet, and stretching the coated sheet to expand the sheet and form the open mesh.

2. A process as claimed in claim 1 in which the metal is a valve metal or a valve metal alloy.

3. A process as claimed in claim 2 in which the valve metal is titanium and the alloy is an alloy of titanium.

4. A process as claimed in any one of claims 1 to 3 in which the sheet has a width in the range 0.02 to 5 meters and a length in the range 0.25 to 5 meters.

5. A process as claimed in claim 1 in which a plurality of parallel slits are formed in the sheet spaced one from another by a distance of not more than 10 mm.

6. A process as claimed in claim 5 in which the slits are spaced one from another by a distance of at least 0.2 mm.

7. A process as claimed in claim 1 in which the sheet has a thickness of not more than 5 mm.

8. A process as claimed in claim 7 in which the sheet has a thickness of at least 0.2 mm.

9. A process as claimed in claim 1 in which a coating of an electrocatalytically-active material is applied to substantially the whole of the surfaces of the slit sheet.

10. A process as claimed in claim 1 in which the coating of an electrocatalytically-active material comprises a platinum group metal and/or a platinum group metal oxide.

11. A process as claimed in claim 10 in which the coating comprises a mixture of platinum and iridium oxide, or iridium oxide.

12. A process as claimed in claim 1 in which the coating of electrocatalytically-active material is applied at a loading of at least 1 $g/m^2$.

13. A process as claimed in claim 12 in which the coating is applied at a loading of not more than 50 $g/m^2$.

14. A process as claimed claim 1 in which the slit sheet is stretched to provide an open mesh having a voidage in the range 80% to 98%.

* * * * *